US009741177B2

(12) United States Patent
Montealegre

(10) Patent No.: US 9,741,177 B2
(45) Date of Patent: Aug. 22, 2017

(54) TRANSIT FARE COLLECTION SYSTEM

(71) Applicant: Haroldo J. Montealegre, Managua (NI)

(72) Inventor: Haroldo J. Montealegre, Managua (NI)

( * ) Notice: Subject to any disclaimer, the term of this patent is extended or adjusted under 35 U.S.C. 154(b) by 0 days.

(21) Appl. No.: 14/064,088

(22) Filed: Oct. 25, 2013

(65) Prior Publication Data

US 2015/0115028 A1 Apr. 30, 2015

Related U.S. Application Data

(60) Provisional application No. 61/829,153, filed on May 30, 2013.

(51) Int. Cl.
*G07B 15/02* (2011.01)

(52) U.S. Cl.
CPC ..... *G07B 15/02* (2013.01)

(58) Field of Classification Search
CPC ..... G07B 15/06; G07B 15/04; G07B 15/00; G06Q 20/20; G06Q 20/3278; G06Q 20/18; G06Q 20/34
See application file for complete search history.

(56) References Cited

U.S. PATENT DOCUMENTS

2006/0218064 A1* 9/2006 Andrews et al. ..... 705/35
2009/0119213 A1* 5/2009 Hammad ..... G06Q 20/32 705/44
2009/0210299 A1* 8/2009 Cowen ..... G06Q 20/10 705/13
2010/0089995 A1* 4/2010 El-Awady et al. ..... 235/375
2011/0302081 A1* 12/2011 Saunders et al. ..... 705/39
2015/0066604 A1* 3/2015 Jeong ..... G06Q 20/145 705/13

* cited by examiner

*Primary Examiner* — Sonji Johnson
(74) *Attorney, Agent, or Firm* — Handal & Morofsky LLC

(57) ABSTRACT

A method and apparatus for collecting transit fares is disclosed. The method implements databases contained within a central database that receive data indicating value. Detectable objects are associated with an identifier, which is then associated with one of the databases. Each identifier stores available fare value data in a database. Detectors that read the identifiers are placed at trip starting and/or endings locations and are coupled or couplable to a local memory that stores the identifiers and associated available fare data. Data sets from the central database comprising an available fare value and its associated identifier are downloaded on to the local memories from the databases. Once a detectable object is detected, its associated identifier is read and a fare is debited from the available fare value. The databases and local memories are periodically updated with updated fare values associated with each identifier.

22 Claims, 7 Drawing Sheets

TRANSIT FARE COLLECTION SYSTEM

TECHNICAL FIELD

The present invention relates to the field of computer-implemented automated fare collection systems in public transportation networks.

STATEMENT REGARDING FEDERALLY SPONSORED RESEARCH OR DEVELOPMENT (Not applicable)

BACKGROUND OF THE INVENTION

Many public transportation networks have introduced automated fare collection systems. Such methods involve automation of operator ticketing and collection systems with the objective of reducing costs by doing away with manual fare collection. Additional benefits include increasing efficiency in fare collection and associated procedures, and reducing fraud, for example that committed by passengers and public transportation network staff.

Typically, a transit system includes a transit sector. Entry into the transit sector is blocked by turnstiles or other fare collecting systems, or another gatekeeper system. Such a transit system would also include entry areas which are freely accessible to the public without the collection of a fare. The principal components of automated fare collection systems are magnetic stripe or contactless fare card vending machines or booths, typically located in an entry area, where passengers can obtain fare cards or add value to existing cards.

Systems may also include machines for adding value to a card, or booths. Such card value increasing machines or booths may be placed within the transit sector portion of the station, where passengers can add value to fare cards in order for the cards to be given the value needed to exit the station after travel from a particular station in which the passenger began his or her trip.

As alluded to above, present systems also include validators, such as turnstiles, fare-gates or other systems—that debit the fare from the passenger's fare card upon passenger entry into and/or exit from the transit sector. Validators are associated with each entry point at which the transit system may be entered. Systems may operate using a variety of protocols, for example, fixed fare for all rides in the system and requiring only the charging of the fare to the card upon entry into the system, typically when the card is swiped to gain entry into the system. Alternatively, when the card is used in an entry turn style, other protocols involve recording the entry turnstile as a trip starting point, and, upon swiping the card at the exit recording the exit turnstile as the trip exit point and charging the fare assigned for the trip to the card at the trip exit turnstile by reducing its value.

These components are linked by computer systems and administration software so that each transaction is recorded and accounted for. Magnetic stripe cards or contactless smart cards may be used as fare cards and may allow the reloading of value on them or not, for example when a card is issued for unlimited rides during a particular time period.

SUMMARY OF THE INVENTION

The inventive system comprises an inventive infrastructure and method meant to be implemented over the inventive system which links mobile money accounts and/or bank accounts and/or credit cards and/or prepaid cards, at one side of the system, to fare cards and/or validators and/or databases, at the other side of the system. This allows for flexible and traceable real time addition of value to and tracking usage of fare cards with attendant real time decrementing of card value and associated information collection and retrieval.

Automated fare collection systems that do not allow stored-value fare cards force passengers to acquire fare cards whose monetary value is consumed or otherwise depleted, for example to a monetary value of zero, through usage and/or through the expiration of a time period. Such systems place strain on associated transportation terminals, for example train station buildings, due to passenger congestion in the terminal building, on account of passengers waiting in line at card vending machines or booths to obtain fare cards or increase the monetary value of existing fare cards which have been depleted of value. Accordingly, relatively large structures are required. Likewise, these systems also burden passengers that must physically go to the card vending machines or booths and wait in line to obtain and/or increase the monetary or time value of fare cards every time that their previous fare cards are depleted of value.

The reason that certain automated fare collection systems do not allow stored-value fare cards is because stored-value fare card systems have higher launching costs in the case of new automated fare collection systems, and, in the case of pre-existing automated fare collection systems, high migration costs.

Automated fare collection systems that allow stored-value fare cards may require that value be purchased at add value machines or booths, in which case the purchased value is immediately added to the fare card.

A system may allow for online adding of value, or automatic top-up of value. In accordance with the present invention, a fare card account is tied to a credit card or bank account. Prior art systems have the disadvantage that online purchase and automatic top-up is usually subject to limits regarding when the online or electronic purchases may be made, some limit orders to before 11 pm for next day collection, and subsequently require visiting an add value machine to collect the value added by the online or electronic purchase.

The problem with automated fare collection systems that rely on add value machines to add value to or collect previously purchased value to the fare cards is that they require passengers to physically visit an add value machine to add value to their cards, whether it be to purchase and add the value or to add previously purchased value to the fare card. By requiring passengers to physically visit an add value machine, these automated fare collection systems cause the same problems as systems that do not allow stored-value fare cards, although time spent at the add value machine is diminished if a prior or online purchase is being collected and the value is only being added to the fare card without the necessity for a purchase to be made at the add value machine; congestion at fare card vending machines or booths is reduced in systems that allow for stored-value fare cards.

The reason that stored-value fare cards must be brought to an add value machine is that for the value to be added, the machines actually write the value onto the magnetic stripe of the magnetic stripe cards or the chip of the contactless smart cards and subsequently, when the fare card is used to pay for a fare, the validator debits the value directly from that fare card at that time.

Some automated fare collection systems allow for usage of prepaid cards, debit cards or credit cards that are not stored-value fare cards as they do not store value directly on the card, but rather the prepaid card, debit card or credit card identifies an account of the prepaid cards, debit cards or credit cards issuer. In the sense that value is not stored in the card rather it is externally recorded and maintained on computers affiliated with the card issuer, the prepaid card, debit card or credit card seems different than the stored-value card which has data physically stored on its contactless chip or magnetic stripe.

However, a prepaid card relies on loading/reloading providers tied to the prepaid card issuer for value to be added to the prepaid card. The debit card requires deposits to be made to the bank account for value to be added. The credit card requires payments to be made for value to be added.

Reliance on these unique channels makes prepaid cards, debit cards and credit cards similar to stored-value fare cards in that they require visiting specific physical locations to add value to them. Furthermore, prepaid card, debit card and credit card usage may cause time delays if the respective card issuer is consulted regarding the prepaid cards, debit card or credit card balance at each payment.

Some automated fare collections systems allow for stored-value fare cards to receive top-ups of value, both manually and automatically from an associated prepaid card, debit card or credit card. However similar to online purchases of value, the fare card does not actually have value added to it until the passenger physically visits an add value machine to collect topped up value to the fare card.

In accordance with the present invention, automated fare collection system passengers are relieved of the requirement of visiting add value machines or booths or specific loading/reloading providers or bank branches to add value to their fare cards, whether it be to purchase and add the value or to collect previously purchased or topped up value to their fare card.

In accordance with the invention, no value is written onto the fare cards' chip or magnetic stripe by the add value machine or debited from the fare card by the validator. The fare card's chip or magnetic stripe only has data written onto it at its time of manufacture. An important element of that data is an identification number that is also printed on the front of the fare card so that system may identify the fare card. The fare card derives the amount of value it has assigned to it at any given time from the amount registered in the central database to the passenger's fare card account, which in turn receives funds from an associated mobile money account, bank account, credit card, prepaid card or the like. When a passenger uses the fare card no value is debited from it as there is no value written on to it, rather the validator reads the card's identification number and compares the fare card's identification to an internal white list stored in a local memory device located in each validator, such as an SD memory card. The validator determines at the time of card utilization whether the registered value it had for the said fare card identifier has sufficient value in the fare card account whose value is also registered onto the validator's whitelist.

Passengers do not add value to the fare card, rather they first may add value to their bank account, make a payment to their credit card, add value to their prepaid card, or add value to their mobile money account or receive a money transfer into their mobile money account. The fare card account, in turn pulls money from the associated mobile money account, bank account, credit card or prepaid card.

The common availability of mobile telephones, particularly in regions which were previously not infrastructure rich, is of particular relevance for use of the inventive system in connection with so-called mobile money accounts, which allow cash to travel as quickly as a text message. With such technology, even small corner shops can perform cash transfer and related functions.

With such systems, a person can not only buy vouchers to top up his or her calling credit for his or her mobile phones, but an individual can also give cash to the operator of the shop, who, by sending a special kind of text message, can credit the cash to that individual's mobile-money account. Individual may then transfer money, also by text message, to other registered users, who can withdraw it by visiting their own local corner shops. An individual may even send money to people who are not registered users who are sent a text message with a code that can be redeemed for cash at a local corner shop.

In accordance with the invention, the inventive automated fare collection system infrastructure may be instructed to attempt to remove funds from the fare card account to pay for a fare. Alternatively, the automated fare collection system infrastructure may be instructed to attempt to remove funds directly from the mobile money account, bank account, credit card, prepaid card or fare card account in a particular order. For example, it may first check the fare card account, and if there are not sufficient funds, the system may, in a selected sequence, withdraw a predetermined amount of funds from one of the other accounts (and put it in the fare card account) in a predetermined order, for example, first checking the mobile money account, and if that fails from the credit card, and if both of these fail from the bank account and to that does not work then from a prepaid card. The fare card account would then be charged with the applicable fare and the passenger allowed to pass.

Alternatively, the system of the invention may not go beyond checking the fare card account. Still another alternative is for the machine to provide to the user an option to charge other accounts, presenting the user with screens for the input of information authorizing charges from such other accounts. This presentation of a screen may be done by, for example, an audio announcement at the turnstile or other validator directing the user to a touchscreen device where he can make the required choice. Such touchscreen would be placed in a position in the station house where the user will not block usage of the turnstile by other users.

In accordance with the invention, the central database registers the credit to the passenger's fare card account from the associated mobile money account, bank account, credit card or prepaid card and notifies all of the validators in the automated fare collection system that the fare card with the number in question has a new value associated to it. Each validator in the automated fare collection system stores the information sent to it by the central database onto an internal whitelist stored in a local memory device located in each validator, such as an SD memory card.

The invention contemplates the use of RFID (contactless smart card) or other equivalent technology. Every time a passenger brings his fare card (such as an RFID fare card) proximate to a validator, the communication between the fare card and the validator causes the transmission to a central server of the information that the passenger is proximate to a validator in a particular station. In the simplest case, this can result in simply charging a fixed transit fare to the fare card account associated with that particular passenger's card. In accordance with the invention, it is contemplated that the RFID detector will be positioned with respect to a gate at a position that will detect the presence of the passenger passing through the fare gate, but at which it is very unlikely to be triggered except by a passenger's passing through the fare gate associated with the particular validator. In this manner the system will detect the presence of the passenger passing through a fare gate at a particular station. It is contemplated that multiple gates may be associated with a single validator, particularly at high traffic stations, thus allowing for a large number of passengers to use the system at the same time.

In other systems, proximity detection of the fare card, presumably in the pocket or wallet of a consumer, will result in the system registering the presence of the consumer at a particular station and validator gate. Such presence may be presumed to be the beginning of a ride with a start point at that particular station. Detection of that passenger a reasonable period of time thereafter at another station may be interpreted by the system as exit from that other station. The system may employ an artificial intelligence algorithm to determine the reasonableness of that conclusion or to determine that something else has occurred, and make the appropriate charge to the fare card account. Alternately, in the event that a ride cannot be constructed, the system may charge a fixed maximum fare, and/or e-mail the passenger to clarify the situation. Human intervention may be appropriate at certain algorithm decision points.

In accordance with yet another alternative, the system may include a plurality of RFID detectors, for example one at the entry point (from the standpoint of a passenger entering the transit system from the public area of the station house) of a particular gate and another at the exit point of the same particular gate. If detections from the two RFID detectors are very close to each other, as would be expected to be the case, a vector may be associated to the movement of the passenger, thus determining whether he is entering the transit system from the public area of a station house for the purpose of boarding transportation or leaving the transit system (after having taken a ride on the transit system) to pass through the public area of the destination station house, presumably to leave the station house and proceed on the walking leg of his trip, having completed his use of the transit system incorporating the inventive technology.

Validator-detected information may optionally be encrypted for transmission to the central server. In accordance with the invention, it is contemplated that when information representing that a charge is to be made to a particular fare card account, the same will be done locally on the white list associated with the validator and their date at which the charge was implemented. This will very quickly prevent the card from being used for multiple fares after the fare card has been depleted.

After the validator has debited the fare card's balance as it is recorded on its internal local whitelist, the system implements a synchronization operation. Synchronization is implemented by sending fare card value depletion information to the central database associated with the central server. In this manner, the central server is notified that the passenger's fare card account with the number associated with the fare card carried by the passenger when he passed through the fare gate is to be debited a certain amount. In the event of multiple accounts being associated with the fare card, that debit charge would be associated with the account or accounts associated to the fare card. This would prompt the server hosting the central database to debit the notified amount from the mobile money account, bank account, credit card or prepaid card that is also associated to that passenger in the event that there are insufficient funds in the fare card account.

After receiving this information, the central database in the central server registers this debit and notifies all of the validators in the automated fare collection system that the fare card with the number in question has a lesser amount of value associated to it by way of the value associated to the associated mobile money account, bank account, credit card or prepaid card so that all of the other validators in the automated fare collection system will record this change in value on their internal whitelists. In this manner all validators in the automated fare collection system notify the central database of all debits that they have initiated, and are informed of 1) all debits initiated by other validators in the automated fare collection system as well as 2) all credits notified to the central database, and in effect all validators carry the same information on their internal whitelists. In other words, all local whitelists have the same information that is registered by the central database relating to all associated mobile money accounts, bank accounts, credit cards and prepaid cards associated with the fare car account.

Likewise any debit made to the passenger's fare card-associated mobile money accounts, bank accounts, credit cards or prepaid cards that are unrelated to the automated fare collection system will also reduce the amount of value that the passenger has in the associated fare card account and thereby reduces the amount of value that his fare card has associated to it.

In addition, fare card usage activity, including detections of proximity of the fare card at a validator, movement through a fare gate associated with a validator (including entry and exit information), time of detection information associated with the foregoing, and/or artificial intelligence algorithm outputs, such as trip reconstruction, or the like may be stored on the central server and on the local whitelist data set at each validator. Alternatively, validators may only store fare card value information.

Accordingly, the present invention allows for the implementation of a new automated transit fare collection system, as well as providing for upgrading of existing automated fare collection systems. It also provides infrastructure for, perhaps dramatically if that is what a particular passenger/consumer wishes to do, increasing the number of channels for passengers/consumers/users to add value to fare cards as any increase in value to the passenger's associated mobile money accounts, bank accounts, credit cards or prepaid cards will increase the amount of value to the passenger's associated fare card. Moreover, this is achieved without a similar increase in costs associated with the implementation of the automated fare collection system. In addition, the inventive system also provides a high degree of flexibility as to where value can be added to accounts associated to fare cards in real time.

Synchronizations between validators in the central database associated with the central server of the automated fare collection system may be carried out over the internet, for example by a virtual private network, by private access point name gateway or similar secure communication protocols. However, the notification to debit value from accounts associated with the fare card is carried out over a separate channel. This can be done by the validator sending a communication to the custodian of the associated account, or the central server sending a communication to the custodian of the associated account. In any event, the notification to debit is carried out in the validator's own whitelist (and communicated as detailed herein) and not as a subtraction from any value registered directly on the chip or magnetic stripe of the fare card. Rather the fare card only has identification information such as a numeric or alphanumeric identifier. As the validator will not write any information onto the chip or magnetic stripe of the fare card and the validator will only read identification information from the fare cards, transactions are necessarily faster than transactions where the validators must read from the fare cards and subsequently write a new value onto their chips or magnetic stripes or transactions that require communication with an external server for the payment to be completed.

Value may be added to the accounts associated to any fare cards in the stated manner by any person with value in their account, by other passengers, mobile money agencies, bank correspondents, electronic funds transfer at point of sale devices, automated teller machines, bank branches or similar channels. Additions may be implemented personally at an appropriate bricks and mortar facility, by cellular telephone, bank kiosk or ATM, etc.

Optionally, in accordance with the invention, each fare card account may be made the only account which is charged for transit services. This may be supplemented by automatic recharging of the fare card account when a predetermined lower limit is reached. Funds may be withdrawn from any associated account automatically to bring the value of the card to a standard systemwide value, to a value selected by the consumer, or to increase the value of the account by a predetermined amount.

Optionally, charges may also be charged against a particular account directly, or such capability may be excluded from system functionality. In the event that usage contemporaneously results in individual fare or fare card value increases in a greater amount, means may be provided for synchronizing accounts other than fare card accounts (because fare card accounts are maintained internally within the transit system with appropriate information stored on a central server of the transit system) with information maintained locally at the validator in each station house.

By allowing for the number on the fare card to be associated to a cellular phone number, a bank account number, a mobile money account or a prepaid card the innovation allows for a passenger's fare card account to receive funds in real time without any need to visit an add value machine.

By allowing for the number on the fare card to be associated to a cellular phone number, a bank account number, a mobile money account or a prepaid card the innovation allows for a passenger to add value to the fare card of another passenger in real time.

By allowing for the number on the fare card to be associated to a government issued identification, a cellular phone number, a bank account number or a mobile money account the innovation allows for a wide range of possibilities for one passenger to identify the other passenger whose fare card he wishes to add value to.

By allowing for the number on the fare card to be associated to a government issued identification the innovation allows for the identification of passengers on fare system in real time for law enforcement, service optimization or government subsidy payments.

By allowing for the number on the fare card to be associated to a government issued identification the innovation allows for a single issue of fare card to be used for all passengers and the government subsidy for a particular passenger to be applied based on the identity of the passenger in the central database and elements subject to change such as age or employment status instead of fixed cards that must be replaced with any change.

By allowing for the number on the fare card to be associated to a government issued identification the innovation allows for a single issue of fare card to be used for all passengers and the government subsidy for a particular passenger to be applied based on the identity of the passenger in the central database and elements not subject to change such as reaching a certain age instead of fixed cards that must be replaced upon reaching said age.

By allowing for the number on the fare smart card to be associated to a government issued identification the innovation allows for a wider range of accurate demographic fare statistics to be generated by fare system in real time.

By allowing for the number on the fare smart card to be associated to a government issued identification, a cellular phone number, a bank account number or a mobile money account number the innovation allows for passengers who lose their fare card to freeze their account in case of a lost or stolen fare card and recuperate the value on the fare card on a new fare card or on a mobile money or bank account.

By allowing for the number on the fare card to be associated to a bank account number or a mobile money account number the innovation allows for passengers to use the same funds for their fare card as they use for other purchases and financial services in real time.

By allowing for the number on the fare smart card to be associated to a government issued identification, a cellular phone number, a bank account number or a mobile money account the innovation allows for demographic marketing data to be generated, keyed to individual passengers, their individual purchasing preferences and their patterns of public transportation usage.

By allowing for value to be added remotely to a central database instead of being written onto the chip or magnetic stripe of the fare card and the validator read from the fare cards, the innovation allows for the transaction to be faster than transactions where the validators must read from the fare cards and subsequently write a new value onto their chips or magnetic stripes.

By allowing for the number on the fare card to be associated to a government issued identification, a cellular phone number, a bank account number or a mobile money account the innovation allows for the traceability of monies used for fares and lowers the risk of money laundering.

This invention allows for new and existing automated fare collection system to exponentially increment channels for users to add value to their fare cards without a similar increase in costs and for the system to allow total flexibility as to where value can be added to cards.

By allowing for semi-online transaction where the debit is done on an internal whitelist installed on the validator (offline payment) while allowing for said whitelist to be constantly updated (online synchronization) the system allows for the speed of offline payments and the flexibility of online real-time synchronization of information.

The invention comprises a method for the collection of transit fares. The inventive method implements a plurality of customer-associated available fare value data receiving databases, each capable of receiving data indicating value, and being contained within a central database. A plurality of detectable objects are manufactured with each object associated with an identifier. The identifier is encoded physically in or on the object, with the encoding being executed in a readable format. The detectable objects are each associated with a respective one of the available fare value data receiving databases using its respective identifier. Each of the identifiers, stores respective available fare value data associated with the respective identifier in the available fare value data receiving database associated with that identifier. A plurality of detectors for detecting detectable objects are placed at a plurality of trip starting and/or ending locations. The plurality of detectors reads the identifier associated with the detectable object. Each of the detectors is coupled or couplable to a respective local memory located proximate its respective trip starting and/or ending location, each of the local memories being capable of storing a plurality of identifiers and associated available fare value data. Central database originated data sets comprising an available fare value and its associated identifier are downloaded, for a plurality of identifiers, from the available fare value data receiving databases to a plurality of the local memories associated with respective detectors. A particular detectable object is detected and the identifier associated with the detectable object is read. A fare to be charged from the available fare value, associated with the detected detectable object and stored in the respective local memory associated with the detector detecting the detectable object is debited. The debiting is done from the available fare value stored in the local memory associated with the detector detecting the detected detectable object to update the available fare value stored in the local memory associated with the detector detecting the detected detectable object. The available fare value data receiving databases are periodically updated by uploading local database originated data sets comprising the updated available fare values associated with the identifiers to the available fare value data receiving databases from the local memories associated with detectors at the trip starting and/or ending locations. The information stored in said local memories is periodically updated by downloading updated central database originated identifier datasets comprising an available fare value and its associated identifier for a plurality of identifiers, from the updated available fare value data receiving databases to a plurality of the local memories associated with said detectors The inventive system may compare, the available fare value associated with the identifier associated with the detected detectable object, to a fare to be charged, and determine whether the associated available fare value is sufficient to pay the fare to be charged in response to the detection of the particular one of the detectable objects by one of the detectors.

The inventive system may store in the local memory proximate the respective trip starting and/or ending location in association with the identifier of the particular detected detectable object, the trip starting and/or ending location where the particular detected detectable object was detected, and the time of detection of the particular detected detectable object.

The inventive system may periodically upload to the central database trip starting and/or ending locations where detected detectable objects were detected, together with the respective time of detection of detected detectable objects associated with the respective identifier to update the detected locations and respective times of detection of detected objects. The information stored in the local memories is periodically updated by downloading to the local memories from the central database, for a plurality of identifiers, the updated detected locations and respective times of detection of detected objects in the updated central database.

The inventive system may determine, upon the detection of a certain detectable object at a certain detection time, a fare to be charged by searching the local memory associated with the detector for a detection of the certain detectable object at a time proximate the certain detection time.

The inventive system may allow passage through a fare gate coupled to said detector if sufficient available value is associated with said detected detectable object following a determination of the fare to be charged. After the determination of the fare to be charged, if insufficient available value is associated with said detected detectable object, passage through a fare gate coupled to the detector will not be allowed.

The inventive system may place a plurality of available fare increasing devices proximate the detectors to allow increasing the value associated with a particular detectable object in a respective local memory.

The available fare value may be expressed as monetary value or value in terms of available transportation services, such as mileage or time.

The detectable object may be an RFID device.

The detector may be coupled to a gate controlling access to or exit from a transit system and the direction of intended movement into or out from the transit system is detected by the detector from the vector of movement of the detectable object.

The inventive system may have more than one detector and a respective associated gate that controls entry into and exit from a transit system that is associated with one or more trip starting and/or ending locations.

The inventive system may compare, in response to the detection of a particular one of the detectable objects by one of the detectors, the available fare value, associated with the identifier associated with the detected detectable object, to a fare to be charged, and determine whether the associated available fare value is sufficient to pay the fare to be charged. The trip starting and/or ending location where the particular detected detectable object was detected, and the time of detection of the particular detected detectable object may be stored in the local memory proximate the respective trip starting and/or ending location in association with the identifier of the particular detected detectable object. Trip starting and/or ending locations where detected detectable objects were detected, together with the respective time of detection of detected detectable objects associated with the respective identifier may be periodically uploaded to update the detected locations and respective times of detection of detected objects. Information stored in the local memories may be periodically updated by downloading the updated detected locations and respective times of detection of detected objects in the updated central to the local memories from the central database, for a plurality of identifiers. A fare to be charged may be determined, upon the detection of a certain detectable object at a certain detection time, by searching the local memory associated with the detector for a detection of the certain detectable object at a time proximate the certain detection time. After the fare to be charged is determined, the inventive system may allow passage through a fare gate coupled to the detector if sufficient available value is associated with the detected detectable object. Once the fare to be charged is determined, the inventive system may not allow passage through a fare gate coupled to said detector if insufficient available value is associated with the detected detectable object, wherein the provision of detectable object identifier-associated information results in reducing the time to determine fare value sufficiency and the time to charge the fare value and reduces lines at said gates.

The available fare value data receiving databases may be accessed and updated over a publically accessible network such as the Internet.

The identifier is may also be printed on the front of the detectable object.

The available fare value may be credited from an associated mobile money account, bank account, credit card, prepaid card or the like and/or may be automatically pulled from another account.

The inventive system may compare, in response to the detection of the particular one of the detectable objects by one of the detectors, the available fare value, associated with the identifier associated with the detected detectable object, to a fare to be charged, and determine whether the associated available fare value is sufficient to pay the fare to be charged, wherein, in the event of determination of insufficient available fare value, a computing device located proximate the location of detection is programmed to attempt to remove funds from a mobile money account, bank account, credit card, prepaid card, fare card account or similar account in a particular order.

The identifier may be associated to a government identification number such as a social security number to assist in individual location and law enforcement and/or the detectable objects may be used to credit cash to another account.

The uploading and downloading may be carried out over a public network, such as the Internet.

The detector may send a communication to the custodian of an account associated with the identifier.

Government subsidies may be directly credited to the available fare value database and use of the subsidies is limited to transportation services.

The inventive system also comprises an apparatus for the collection of transit fares. a plurality of available fare value storage sectors of memory for storing customer-associated available fare value data indicating value. The available fare value data storage sectors form a central storage system. The inventive apparatus has a plurality of detectable objects, each being associated with an identifier that is physically stored and positioned in or on the detectable object. The identifier is in a readable format with each of the detectable objects being associated with a respective one of the available fare value storage sectors using its respective identifier. Each of the identifiers has a storage sector for storing respective available fare value data associated with the respective identifier in the available fare value storage sectors associated with that identifier. A plurality of detectors for detecting the detectable objects and reading the identifier associated with the detectable object are placed at a plurality of trip starting and/or ending locations. Each of the detectors is coupled or couplable to a respective local storage sector that is located proximate its respective trip starting and/or ending location. Each of the local storage sectors is capable of storing a plurality of identifiers and associated available fare value data. The inventive apparatus has a means for coupling the central storage system to the available fare value storage sectors and said local storage sectors and a means for coupling the local storage sectors to the detector detecting the detectable object which has a storage sector for storing associated available fare value.

The inventive apparatus may have a fare gate coupled to the detector.

The inventive apparatus may have a plurality of available fare increasing devices placed proximate to the detectors that allow increasing the value associated with a particular detectable object in a respective local memory.

The available fare value storage sectors may store the customer associated available fare value as monetary value or value in terms of available transportation services, such as mileage or time.

The detectable object may be an RFID device.

The detector may be coupled to a gate that controls access to or exit from a transit system.

The inventive apparatus may have more than one detector and a respective associated gate that controls entry into and exit from a transit system at one or more trip starting and/or ending locations.

The available fare value storage sectors may be coupled or couplable to a publically accessible network such as the Internet.

The identifier may also be printed on the front of the detectable object.

The available fare value storage sectors may be coupled or couplable to a mobile money account, bank account, credit card, prepaid card or the like.

The inventive apparatus may have a computing device located proximate to the location of detection which allows for the removal of funds from a mobile money account, bank account, credit card, prepaid card, fare card account or similar account in a particular order.

The identifier may be configured in the system to be coupled or couplable to a government identification number such as a social security number to assist in individual location and law enforcement.

The detector may be configured to send information to the custodian of an account associated with the identifier.

BRIEF DESCRIPTION OF THE DRAWINGS

The operation of the inventive method and system will become apparent from the following description taken in conjunction with the drawings, in which.

DETAILED DESCRIPTION OF THE PREFERRED EMBODIMENTS

In accordance with the present invention, it is possible for a passenger to access funds from a mobile money account, bank account, credit card or prepaid card associated to a fare card in real time, without the need to visit an add value machine, with a cellular phone or on an internet site; or to receive value on his fare card account from any other person in real time, all as every validator and every fare card in the automated fare collection system is linked with the central database and all transactions are carried out therein in real time. Using the process illustrated in FIG. 1, a passenger ABC may obtain a fare card or register a pre-existing fare card and associate it to a mobile money account, bank account, credit card or prepaid card. In accordance with the preferred embodiment, passengers may associate their cellular phones and government issued identification to their fare card, however, neither is necessary for implementation of the invention.

While it is contemplated that cellular phones registered by a passenger/system user to be associated to their fare cards are from different mobile network operators, optimization of the inventive system does not depend on this and cellular phones registered by passengers to be associated to their fare cards may be limited to a single mobile network operator.

Figure 1:
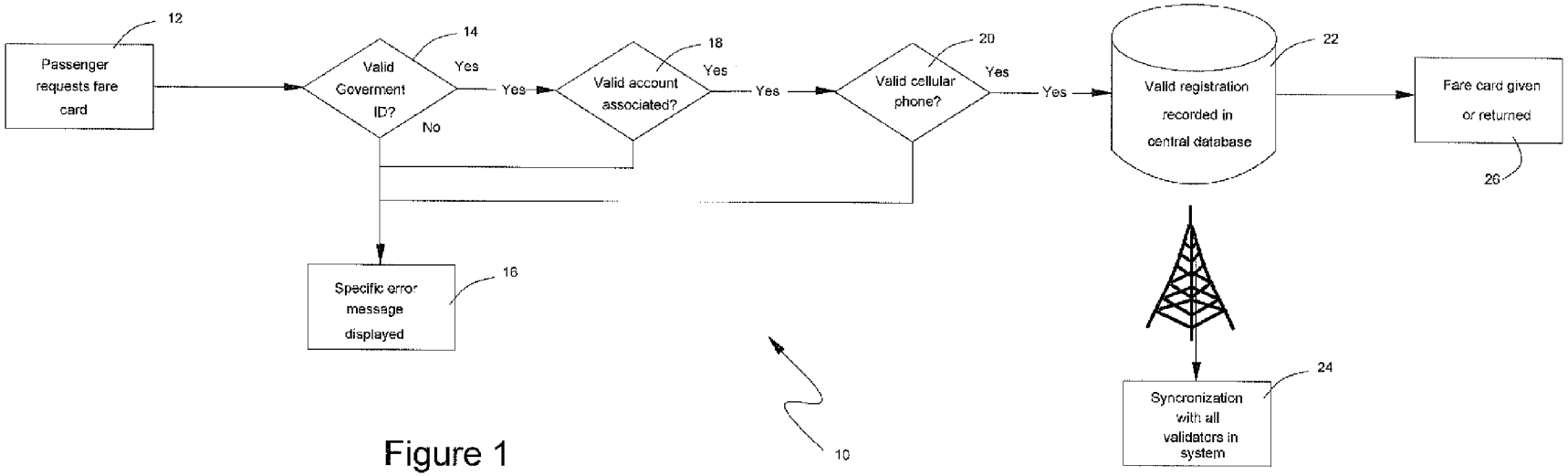
FIG. 1 is a diagram illustrating that portion of the method of the present invention as is implemented by one passenger that obtains a fare card or registers a pre-existing fare card and associates it to a mobile money account, bank account, credit card or prepaid card.

Referring to FIG. 1, a methodology 10 for implementing the present invention is illustrated. The process may begin with a passenger ABC obtains a fare card, for example at step 12 from a vending machine. That card is associated with an identification number which is encoded, for example, in the magnetic stripe or RFID device or other chip or other identification device capable of being sensed by being swiped over a magnetic card reader, or at a distance by coming into proximity with a detection device, such as an RFID detector.

In accordance with the present invention, the card would be dispensed by a vending machine located in a station house, underground transportation system entry point, or the like. It accords with the preferred embodiment, before a machine dispenses the fare card, the passenger is provided with a number of options as will be detailed below.

Alternatively, a passenger has the option of registering a pre-existing fare card, originally dispensed to another person, such as a relative or friend. The individual can then take that fare card and insert it into the same vending machine which would be used to dispense new fare cards, and continue the process in the same manner as a newly dispense card.

More particularly, the fare card inside the dispensing apparatus, whether a new fare card or one acquired from another person for purposes of being used by a new user, is associated with a particular number or other identifier. The passenger is given the option of associating that fare card in the machine to a mobile money account, bank account, credit card and/or prepaid card in accordance with the present invention.

Thus, at step 12, passenger ABC requests a new fare card or requests to register a pre-existing fare card. While it is contemplated that the operation will be done automatically in a vending type machine, a pre-existing fare card may be given to an attendant in a station house booth, fare card office, or agent as an alternative to introducing the old fare card into the fare card vending machine. In accordance with the present invention, use of a fare card vending machine is preferred. Such a machine would include a display, such as a touch screen for displaying options and allowing me user to input selections.

At step 14 the fare card office, agent or fare card vending machine will request that the passenger present their government issued identification for validation and association. The same may be optically scanned. Subsequently, the system may give passenger ABC the opportunity to associate a valid mobile money account, bank account, credit card and/or prepaid card with the fare card. If the government issued identification presented by the passenger cannot be recognized, or if none is presented, an error message stating that no government issued identification or an invalid (or unreadable) government issued identification has been presented will appear, for example, on the screen of the fare card agent's computer or on the fare card vending machine display at step 16. The government issued identification card is also verified at step 18. If verification fails, an appropriate error message is presented at step 16.

Passenger ABC then has the opportunity to register a valid mobile money account, bank account, credit card or prepaid card with the system at step 18. This may be done by typing in the name of the credit card issuer (for example Visa or MasterCard) on a virtual typewriter keyboard presented on the touchscreen, and also entering the card number and the three digit identification code, together with the expiration date. The system then also verifies the authenticity of the card at step 20. If verification fails, an appropriate error message is presented at step 16.

In addition, the system requests that the passenger also associates his cellular phone number to the fare card. The system then also verifies the authenticity of the card at step 20. If verification fails, an appropriate error message is presented at step 16.

Likewise, and alternatively, in the event of entry identification information, scans, or the like is done by a human attendant in, for example, a booth, with the human attendant entering the information into a computer, where the passenger did not register a valid government identification card, mobile money account, bank account, credit card or prepaid card with the system, an error message stating that no valid account has been associated will appear on the fare card office or agents computer or on the fare card vending machine display at step 16.

In accordance with the present invention, verification may be done via the Internet by communicating with commercial, bank, government or other applicable databases, depending upon where the information is available for use in connection with such transactions. If the passenger did not register a valid cellular phone number with the system, an error message stating that no valid cellular phone number has been associated will appear on the fare card office or agents computer or on the fare card vending machine display at step 16.

However, in most cases valid information is entered, in the main example by the passenger at a fare card vending/card updating machine as described above, and because the passenger registered a valid cellular phone number with the system at step 20, and/or other information steps 14 and 18, the applicable identification and/or account information is stored in the central database, which registers the associations of the government issued identification and the cellular phone to the mobile money account, bank account, credit card or prepaid card with the associated to the fare card. This allows any of the four elements to be used interchangeably by the system which stores them, for the purpose of identifying the passenger, at step 22.

It is thus seen that the fare card does not have any value associated to it directly. Rather, at that point, any value is associated to the mobile money account, bank account, credit card or prepaid card which in turn is associated to the fare card, as appears more fully below. At step 24 the central database synchronizes proximity detection and value information with all validators in the system, for example over the Internet, with each validator receiving information sent from the central database and each validator sending all its local information to the central database. Synchronization can occur often, for example at one minute intervals.

After the passenger has put in the information to be associated with the card, at step 26 the fare card vending machine (or fare card office, or agent) gives the passenger the new fare card or returns the newly registered pre-existing fare card.

It is noted that the inventive system may be implemented with one of two options for associating value with the card. In accordance with one option, use of the cards results indirectly debiting associated accounts (such as a mobile money account) in accordance with that option, the passenger may need to await the signal, such as a green light, before completely passing through the fare gate, and in the event of insufficient funds, receiving an audio message or video display message directing the passenger to use another card or access to transit system in some other fashion. In accordance with this option, funds are withdrawn from the associated, for example, mobile money account, as the passenger enters or leaves the transit system.

A second preferred option is for the server to associate a particular monetary value with a given fare card's fare card account which is centrally maintained in the automated fare collection systems servers and not directly on the fare card. That monetary value is loaded into the fare card account by debiting the associated, example, mobile money account. Editing of the associated mobile money account may be done in accordance with any crediting algorithm. For example, a preferred algorithm in accordance with the attention is to set a fare card low value and they are card high-value, with the fare card being charged to the fare card high-value when the system detects a value below the fare card low value. This has the advantage of maintaining a balance in the fare card account which is always usable and which, perhaps more importantly, can be accessed with much greater speed than the accessing of funds from a third party providers such as a mobile money account or bank credit card, or the like.

The inventive system utilizes a number methodologies for charging a fare card account. For example, referring to FIG. 2, a methodology 30 is presented and which may be employed by one passenger adding value to the account of another passenger with a cellular phone in accordance with the present invention.

In accordance with this aspect of the preferred embodiment, the system optionally requests that the passenger adding value to the other passenger's associated account authenticate the transaction, for example by entering a four digit personal identification number ("pin number") or answering an email. However, it is not necessary that this step be required for the system to operate. For example, a parent may wish to allow the debiting of his account for the price of a round-trip fare, or some greater amount to a child without authorization, in order to have peace of mind. This debiting up the parent's account can be done without authorization, because the amount of money at issue is relatively small, and, indeed, may be selected by the parent. Likewise, there may be a limit on the number of times that the count may be debited without authentication as an additional protection. For example, the limit may be once or twice a day. Thus, peace of mind may be provided at minimal risk.

Authentication may take any one of a number of forms. For example, authentication can be done with an additional code given to the individual who is seeking a credit to his fare card account. Alternatively, the same may be done by text message, e-mail or the like communication to the holder of the account being debited. This communication would seek a specific authentication, for example the entry of a pin number or the like.

In accordance with the preferred embodiment of the invention, the system requires that both the passenger adding value to the other passenger's associated account and the passenger receiving value on his associated account be registered for the transaction to take place, but again this need not be a requirement for the system to operate, and different options may be provided through either system design or user selection. In accordance with the invention, it is contemplated that, for example, if access to funds from an account of a transferring user to a receiving user is to be by a particular cellular telephone (or other device), the system would implement a registration procedure using that cellular telephone of the receiving user and seeking authentication from the transferring user via a device specified at the time that the fare card account is setup.

Figure 2:
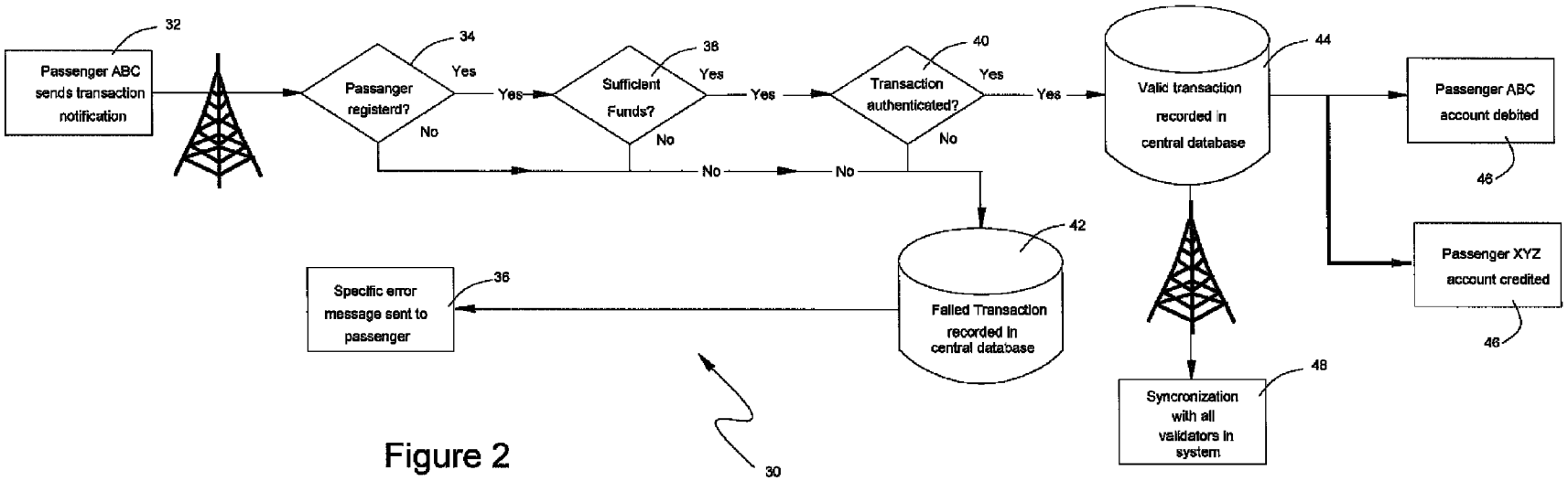
FIG. 2 is a diagram illustrating that portion of the method of the present invention as is implemented by one passenger adding value to the account of another passenger with a cellular phone.

By way of example, as illustrated in FIG. 2, at step 32, passenger ABC decides to add value to passenger XYZ's associated account and sends a notification from his cellular phone to the central database by short messaging services, unstructured supplementary service data, interactive voice response, subscriber identity module application toolkit or mobile application.

Passenger ABC may alternatively initiate the transaction by bringing his near field communication enabled cellular phone and touching it against passenger near field communication enabled cellular phone while running a mobile application dedicated to this purpose.

Returning to FIG. 2, at, the central database receives the notification and determines whether passenger ABC and passenger XYZ are registered for the transfer of value from one fare card account to another. If the system detects that both are registered for this purpose, it verifies if passenger ABC has sufficient funds in the associated account to enable the transfer of the desired amount, by debiting of funds from passenger ABC's account and addition of value to passenger XYZ's account. If the system determines at step 34 that either passenger ABC or passenger XYZ is not a registered passenger, or that the funds are insufficient at step 38, or that the transaction is not authenticated at step 40 the system proceeds to register the failed transaction in the central database and terminate the transaction at step 42. At that point, the system sends at step 36 the unregistered passenger an error message with an invitation via short messaging services, unstructured supplementary service data, interactive voice response, subscriber identity module application toolkit or mobile application to register for future value transfers to or from his fare card. Similarly, the other passenger is given, at step 36, the same notification if he or she is unregistered, and if that passenger is registered, a similar notification explaining the reason for the failure of the transaction.

If the system detects that there are sufficient funds in said account, and that the passengers registered, the system requests that passenger ABC authenticate the transaction. This can be done by sending the transferring passenger an email or other communication, requesting, for example, authentication information such as a four digit pin number. If the system determines that passenger ABC cannot authenticate the transaction at step 40, or if there were insufficient funds in passenger ABC's associated account in step 38, the system proceeds to register the failed transaction in the central database and terminate the transaction at step 42 and send an error message stating whether there were insufficient funds or the transaction was improperly authenticated at step 36.

If the central database determines that passenger ABC can authenticate the transaction, and that requirements for registered users and funds are met, the transaction is deemed valid. When I was occurred, the valid transaction is recorded in the central database step 44.

At step 46 synchronization is implemented. Synchronization occurs at the experience of time or example once each minute at a predetermined time, for example at the beginning of the minute. When this occurs, passenger ABC's associated account is debited by the transaction amount and passenger XYZ's account is credited by the same amount. At step 48 the central database synchronizes with all validators in the system so that all validators are sent the latest fare card account information sent from the central database after all the validators have transferred all of their information to the central database.

In accordance with the invention, it is noted that the passenger that wishes to send value from his associated account to the associated account of another may use his cellular phone and use already existing mobile connectivity infrastructure. Likewise, communication between validators and the central server also utilizes existing Internet infrastructure. In addition, the system of the present invention is tied into and utilizes existing financial infrastructure. Thus, the inventive system is particularly inexpensive to implement as compared to prior art standalone systems. In connection with this, it is noted that any computer program and communications protocol that allows for a passenger to send the desired notification to the central database may be utilized in accordance with the present invention, with little or no change to the described methodology. Moreover, the same will achieve identical or substantially identical functionality.

In accordance with the invention, it is also contemplated that any passenger may send value from his fare card account to any other fare card account by accessing an internet website, which can provide the methodology described herein. In this manner any passenger may remotely share value in fare card account with another passenger that may be far away so that the receiving passenger may use his fare card with those funds. In this case, communication via an internet site (operated by the operator of the inventive transit fare collection system) will generate the notifications to the central database.

Figure 3:
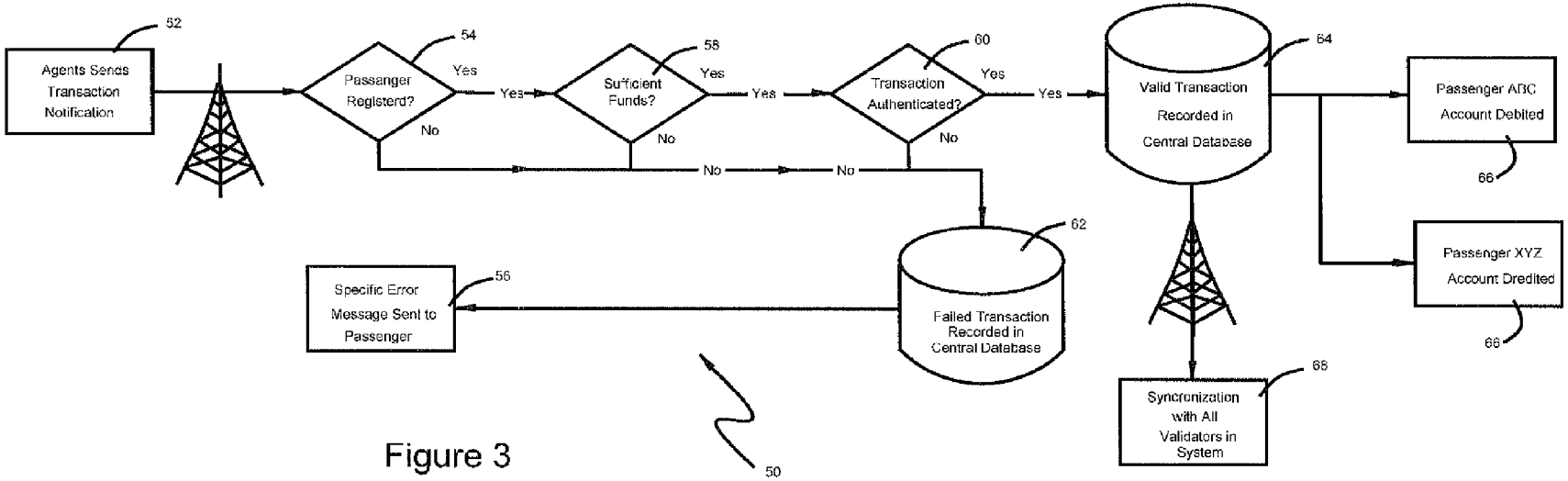
FIG. 3 is a diagram illustrating that portion of the method of the present invention as is implemented by a mobile money, banking agent, Electronic Funds Transfer at Point of Sale Devices or Automated Teller Machine adding value to the account of a passenger.

Referring to FIG. 3, a methodology 50, which may be employed in conjunction with methods 10 and 30, involves the participation of a mobile money or banking agent. In accordance with the invention, a mobile money or banking agent may add value to the account of a passenger utilizing methodology 50. The same may be achieved using the passenger's cellular phone or using an internet site or an electronic funds transfer at point of sale device or automated teller machine. In accordance with a preferred embodiment, the system requires that both the agent adding value and the passenger receiving value be registered for the transaction to take place, but this need not be a requirement for the system to operate. By registration in accordance with the present invention, is meant a process whereby an individual, such as a passenger, inputs into the system, for example via the Internet, his authorization to implement a particular feature. Such registration may also entail a selection of passwords, or other security or convenience features for the particular operation being authorized.

That aspect of the inventive process comprising methodology 50 begins at step 52, where they mobile money or banking agent begins the sub process of adding value to passenger ABC's account. In accordance with the invention, it is contemplated that the passenger will provide the agent with funds, for example in cash or with a credit card, and that the agent will advance funds from his account with the transit system to pay for additional fare card value to be added to the fare card account of the passenger. Naturally, the agent will receive from the passenger funds having a value greater than that which he will be transferring to the transit system. This can be accomplished by a surcharge being charged by the agent for the convenience of recharging (that is increasing the value of) the transit fare card account at a remote location, or for the convenience of recharging the transit fare card account of, for example, a child. However, it is contemplated that in most circumstances, the transit system will pay the agent a commission, thus enabling him to make a profit.

In accordance with the invention, the agent begins the process by sending a notification to the central database, for example by logging onto the system's internet website or from the agent's cellular phone by short messaging services, unstructured supplementary service data, interactive voice response, subscriber identity module application toolkit or mobile application. The notification includes the identity of the agent, the nature of the transaction (the adding of funds), an indication of the amount of funds to be added to the card account, the identity of the passenger, and any verification data. Verification data for the passenger may be input from a separate terminal input device coupled to, for example, the personal computer of the agent.

Alternatively, a mobile money or banking agent may also initiate the transaction by bringing his near field communication enabled cellular phone and touching it against passenger ABC's near field communication enabled cellular phone while running a mobile application developed for this purpose. Such action may cause the automatic addition of a predetermined amount to the fare card account of the passenger. Alternatively, messaging capability of any kind as detailed herein, may be used for selection of an amount to be added to the fare card account and or verification.

The addition of funds may also be achieved at an electronic funds transfer point, such as a point-of-sale device or automated teller machines. For example, passengers may even be given the opportunity of increasing the amount of their fare card at certain stores, in much the same manner that they are given a cashback option. Likewise, the electronic funds transfer at a point of sale device or automated teller machine may require that passenger ABC input certain information into it to initiate the transaction, for the purpose of, for example, security verification.

At step 54, the central server receives the notification from the agent and consults with the central database to determine whether the agent and the passenger receiving the value are registered for the transaction identified in the notification. If the system detects that both the agent and passenger ABC are so registered, it verifies that the agent has sufficient funds in his agent account to enact the desired debit of funds from the agent account and addition of value to passenger ABC's account. If the system determines that either the agent or passenger ABC are not registered, or that the transaction cannot be authenticated for any reason, the system proceeds to register the failed transaction in the central database and terminate the transaction at step 62. At that point, the system sends the unregistered party an error message via short messaging services, unstructured supplementary service data, interactive voice response, subscriber identity module application toolkit or mobile application with an invitation to register to his fare card or agent account or other appropriate message at step 56.

On the other hand, if the system detects that there are sufficient funds in the agent account it requests that the agent authenticate the transaction. If the system determines that the agent cannot authenticate the transaction at step 60, or if there were insufficient funds in the agent account in step 58, the system proceeds to register the failed transaction in the central database and terminate the transaction at step 62 and send an error message stating whether there were insufficient funds or the transaction was improperly authenticated, and does this at step 56.

If the central database determines that the agent can authenticate the transaction then the valid transaction is recorded in the central database at step 64. At step 66 the agent's account is immediately debited by the transaction amount and passenger ABC's account is simultaneously credited by the same amount.

At step 68 the central database synchronizes with all validators in the system so that they may obtain the information sent from the central database and send all of their information to the central database. This is the same synchronization step as occurs at steps 24 and 48, which is periodically implemented by the system, for example once each minute. This is in contrast to the charges made which are immediate resulting in credit being registered at the database in the central server and charges being made to the sending account as soon as the transaction is completed. However, synchronization of this information from a central server, for example, to all validators in the system occurs at regular intervals, for example once each minute.

In accordance with the invention, it is noted that the agent, electronic funds transfer at point of sale device or automated teller machine that wishes to send value from his agent account to the associated account of a passenger may use any established communications channel, such as his cellular phone which is particularly convenient because it can establish mobile connectivity. However any computer program and communications protocol that allows for the agent to send the desired notification to the central database will allow him to do so and the described methodology will operate as intended and herein defined.

Figure 4:
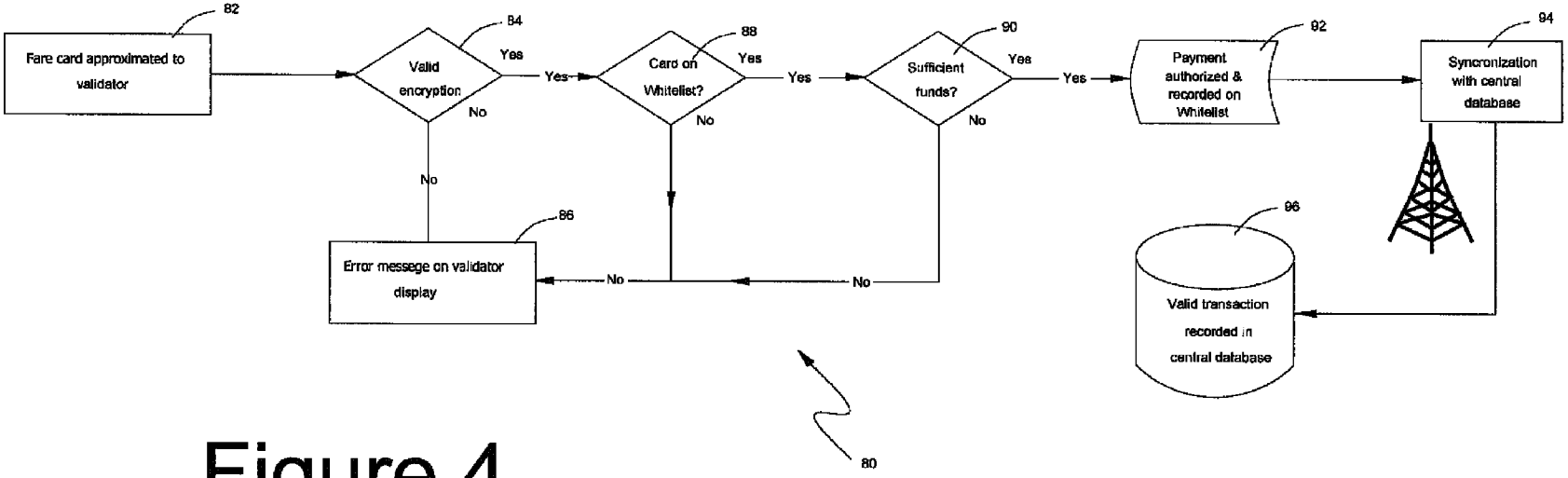
FIG. 4 is a diagram illustrating that portion of the method of the present invention as is implemented by a validator reading a number from a fare card and internally registering a debit of an equal amount on its internal whitelist.

Turning next to FIG. 4, the methodology 80 employed by a validator reading a number from a fare card brought into proximity with the validator while a passenger is passing through a fare gate, and internally registering a debit of an equal amount to the fare card account associated with the number on the proximate fare card on its internal local whitelist in accordance with the present invention is illustrated. In accordance with the preferred embodiment, the communication between the fare card (that is to say the detection of the number or other alphanumeric designator associated with the fare card) and the validator is optionally encrypted. However, encryption only provides a degree of security and is not necessary for the system to operate.

At step 82 the passenger brings his fare card to the validator for payment of the fare. This can be by a hand swiping motion near detector, the detection of the fare card in the pocket of the passenger as he is passing to a fare gate, or by the passenger bringing an optically coded fare card proximate a barcode scanner or other device.

In accordance with the invention, fare cards may be provided with encryption keys which serve the purpose of identifying the fare cards as being associated with the particular transit system. More particularly, fare cards may be obtained from RFID card producers, optical card producers, or others who supply numerous customers in various businesses with detector cards or mechanisms. Each customer has associated with his cards unique encryption keys which allow only cards associated with the customer system to be used.

Once the fare card is detected, at step 84 the validator determines whether the fare card contains appropriate encrypted keys to initiate encrypted communication with validator. If the validator detects that the fare card does contain encryption keys, it verifies if the fare card number is present in its internal whitelist contained on a chip or other memory device which may typically be internal to the validator. If the fare card does not contain encryption keys, the validator displays an error message stating that the fare card is not valid at step 86. This error message is displayed on a display device, such as a touchscreen or non-touchscreen LCD device, or the like, which is associated with the validator and visible at the point where the fare card is detected.

On the other hand, if the validator finds the fare card number registered on its internal whitelist at step 88, the validator checks at step 90 to see if there are sufficient funds associated with that fare card number as stored on its internal whitelist. If the validator does not find the card number registered on its internal whitelist or if there are not sufficient funds associated with the fare card account associated with the fare card on the internal whitelist, the validator display presents an error message stating that the fare card was not recognized or that sufficient funds are not available at step 86.

On the other hand, if the validator determines that the fare card account associated with the number stored on the fare card has sufficient funds associated to it as recorded on the validator's internal whitelist, at step 90, the validator authorizes the payment and then records the debit on its internal whitelist at step 92. At predisposed intervals the validator synchronizes with the central database via the Internet, general packet radio service or any other appropriate communications option, and notifies the central database associated with the server of the debits that it recorded onto its internal whitelist at step 94 during the period since the last synchronization. The central database debits the notified amounts from the mobile money account, bank account or prepaid card associated to that passenger in question in step 96.

In accordance with the invention, it is noted that the validator connects to the central database using the Internet or general packet radio service or any other suitable communications methodology. More particularly, any communications protocol that allows for the validator to send the desired notification to the central database at a frequent and to go with sufficient reliability will allow the implementation of the invention, for example in the matter of the described methodology, and will operate as intended and herein set forth.

Figure 5:
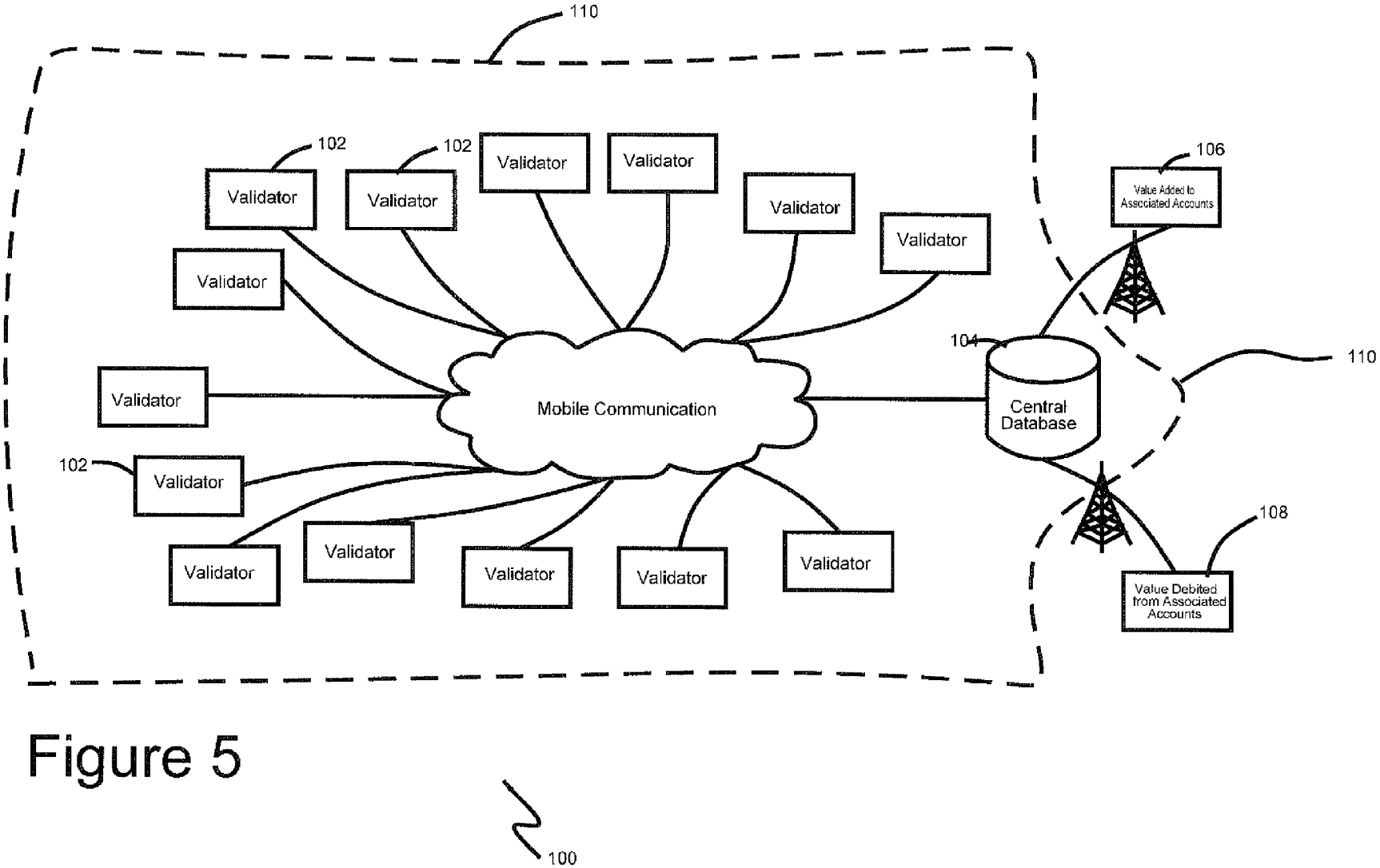
FIG. 5 is a diagram illustrating that portion of the method of the present invention as is implemented by all validators synchronizing with the central database to send and obtain updates.

Referring to FIG. 5, a system 100 employed by all validators 102 synchronizing with the central database 104 through the sending and receiving of updates in accordance with the present invention is illustrated. In accordance with the preferred embodiment, the communication between the validators 102 and the central database 104 is optionally encrypted, but it is not necessary that encryption be done for the system to operate.

Periodically, for example once each minute, each validator 102 synchronizes with the central data base in a centralizing data transmission step by sending to central database 104 all of the debits validator 102 has registered in its internal whitelist contained in a local memory chip since the centralizing data transmission step in the previous synchronization. After central database 104 has registered all of the debits sent by all of the validators 102 to the accounts associated with the paying passengers, the system makes a decentralizing data transmission step. During the decentralizing transmission step, data from central database 104 is distributed to each and all of the validators 102 system 100. Accordingly, information which is complete as of the time of the centralizing data transmission step is then stored locally at each of the validators 102 in system 100.

In principle, value adding and values debiting transactions external to the transit fare card system 110 may be communicated to central database 104 in real time. Alternately, these credits and debits may be periodically updated to the system in synchronization operations, for example a supplemental synchronization operation timed to occur once each minute.

For example, periodically, all of the transactions involving the addition of value to passengers' accounts from operators outside the transit card system, such as local stores offering banking services or other agents, may be registered in the central database. Likewise, all of the value debited from passengers' accounts by agents 108 outside of the automated fare collection system, may be registered in the central database in a periodic synchronization step.

Application of credits from agents 106 outside the transit card system may be debited to customers accounts as they are received. Then, during the next synchronization step, this information may be downloaded from the central database, sending all of the validators in the system such external debit and credit information for storage on their internal whitelists. In this manner, all internal white lists are updated with information involving both the lessening in value of a fare card account resulting from debits on other validators and debits initiated from outside the automated fare collection system, as well as the increases in value resulting from additions of value by agents 106 outside the fare card system as well as passengers using the transit system.

Figure 6:
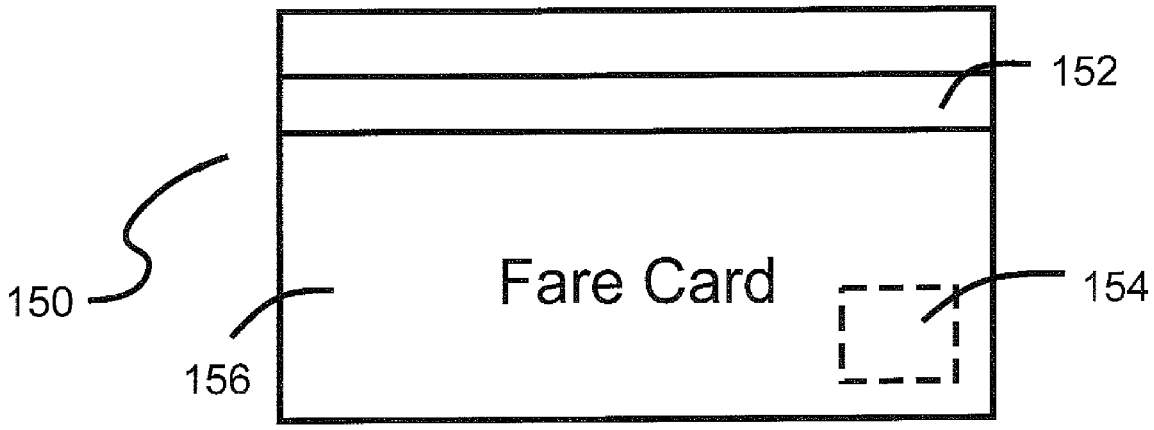
FIG. 6 illustrates the fare card for implementing the present invention.

Referring to FIG. 6, a fare card 150 in accordance with the present invention is illustrated. In accordance with the preferred embodiment, fare card 150 may have either a magnetic stripe 152, or a contactless smart chip 154. The fare card also includes an identification number that is written onto the magnetic stripe 152 or recorded in the contactless smart chip 154.

Figure 7:
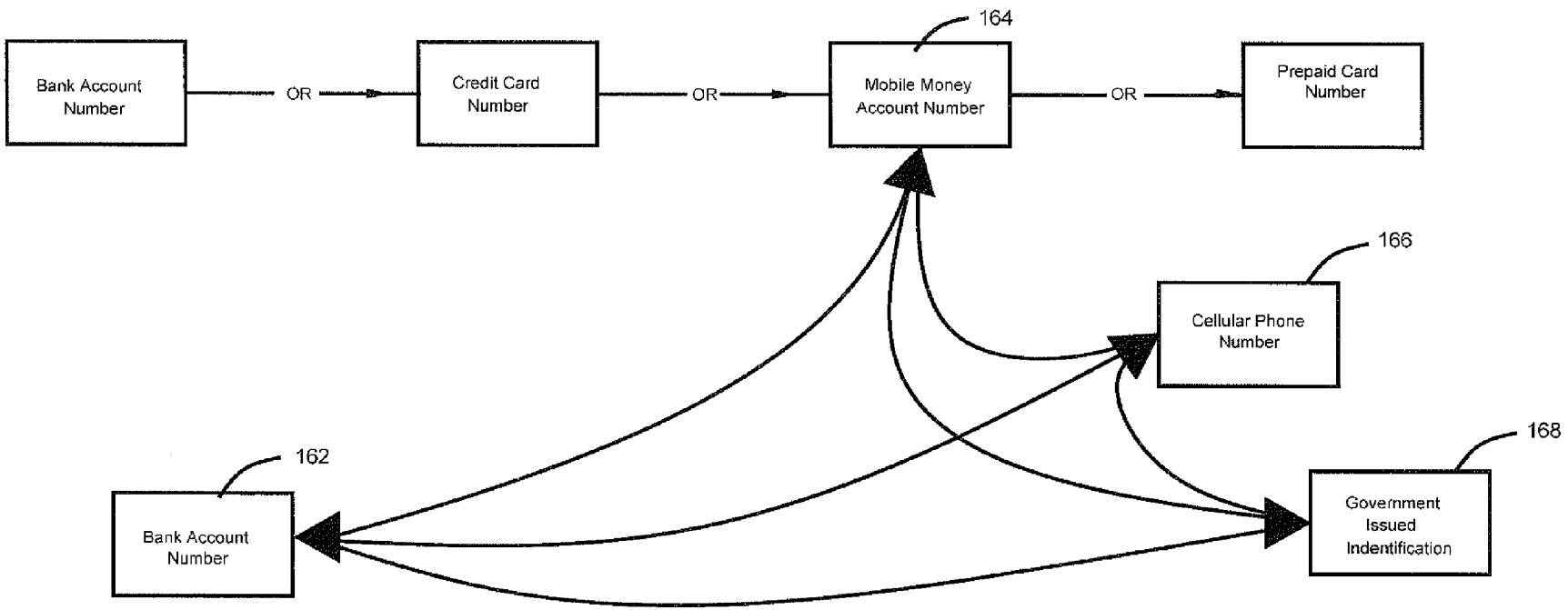
FIG. 7 illustrates the association of accounts to the fare card.

Referring to FIG. 7, the association of accounts to the fare card in accordance with the present invention is schematically illustrated. Fare card 162 is associated to a mobile money account, bank account, credit card or prepaid card 164, as well as a cellular phone number 166 and a government issued identification 168. In accordance with the preferred embodiment, passengers will associate their cellular phones and government issued identification to their fare card. However, neither is a precondition for the invention to operate properly.

While illustrative embodiments of the invention have been described, it is noted that various modifications will be apparent to those of ordinary skill in the art in view of the above description and drawings. Such modifications are within the scope of the invention which is limited and defined only by the following claims.

What is claimed:

1. A method for collection of transit fares, comprising:

(a) implementing a plurality of customer-associated available fare value data receiving databases, said available fare value data receiving databases each for receiving data indicating value, said available fare value data receiving databases being contained within a central database;

(b) manufacturing a plurality of detectable objects, each of said objects being associated with an identifier;

(c) encoding said identifier physically in or on each of said objects, said encoding being executed in a readable format;

(d) associating each of said detectable objects with a respective one of said available fare value data receiving databases using its respective identifier;

(e) for each of said identifiers, storing respective available fare value data associated with the respective identifier in the available fare value data receiving database associated with that identifier;

(f) placing, at a plurality of trip starting and/or ending locations, a plurality of detectors for detecting detectable objects and reading the identifier associated with such detectable object, each of said detectors being coupled or couplable to a respective local memory located proximate its respective trip starting and/or ending location, each of said local memories for storing a plurality of identifiers and associated available fare value data;

(g) downloading, for a plurality of identifiers, from said available fare value data receiving databases to a plurality of said local memories associated with respective detectors, central database originated data sets comprising an available fare value and its associated identifier;

(h) detecting a particular detectable object and reading the identifier associated with such detectable object;

(i) debiting a fare to be charged from the available fare value, associated with the detected detectable object and stored in the respective local memory associated with the detector detecting the detectable object, said debiting being done from the available fare value stored in the local memory associated with the detector detecting said detected detectable object to update the available fare value stored in the local memory associated with the detector detecting said detected detectable object;

(j) frequently updating said available fare value data receiving databases by uploading, to said available fare value data receiving databases from said local memories associated with detectors at said trip starting and/or ending locations, local database originated data sets comprising the updated available fare values associated with said identifiers;

(k) frequently updating information stored in said local memories by downloading, for a plurality of identifiers, from the updated available fare value data receiving databases to a plurality of said local memories associated with said detectors, updated central database originated identifier datasets comprising an available fare value and its associated identifier.

2. A method as in claim 1, wherein said updating is performed frequently enough to determine with reasonable certainty whether said associated available fare value is sufficient to pay said fare to be charged.

3. A method as in claim 2, further comprising:

(m) storing in said local memory proximate the respective trip starting and/or ending location in association with the identifier of the particular detected detectable object, the trip starting and/or ending location where the particular detected detectable object was detected, and the time of detection of the particular detected detectable object.

4. A method as in claim 3, further comprising:

(n) frequently uploading to said central database trip starting and/or ending locations where detected detectable objects were detected, together with the respective time of detection of detected detectable objects associated with the respective identifier to update the detected locations and respective times of detection of detected objects; and (o) frequently updating information stored in said local memories by downloading to said local memories from said central database, for a plurality of identifiers, the updated detected locations and respective times of detection of detected objects in the updated central database.

5. A method as in claim 4, further comprising:

(p) determining, upon the detection of a certain detectable object at a certain detection time, a fare to be charged by searching the local memory associated with the detector for a detection of said certain detectable object at a time proximate said certain detection time.

6. A method as in claim 5, further comprising:

(q) following said determination of said fare to be charged, allowing passage through a fare gate coupled to said detector if sufficient available value is associated with said detected detectable object; and (r) following said determination of said fare to be charged, not allowing passage through a fare gate coupled to said detector if insufficient available value is associated with said detected detectable object.

7. A method as in claim 6, further comprising:

(s) placing a plurality of available fare increasing devices proximate said detectors to allow increasing the value associated with a particular detectable object in a respective local memory.

8. A method as in claim 1, wherein available fare value is expressed as monetary value or value in terms of available transportation services.

9. A method as in claim 1, wherein the detectable object is and RFID device.

10. A method as in claim 1, wherein the detector is coupled to a gate controlling access to or exit from a transit system and the direction of intended movement into or out from the transit system is detected by said detector from the vector of movement of said detectable object.

11. A method as in claim 1, wherein more than one detector and a respective associated gate controlling entry into and exit from a transit system is associated with one or more trip starting and/or ending locations.

12. A method as in claim 1, further comprising:

(l) comparing, in response to the detection of said particular one of said detectable objects by one of said detectors, the available fare value, associated with the identifier associated with the detected detectable object, to a fare to be charged, and determining whether said associated available fare value is sufficient to pay said fare to be charged;

(m) storing in said local memory proximate the respective trip starting and/or ending location in association with the identifier of the particular detected detectable object, the trip starting and/or ending location where the particular detected detectable object was detected, and the time of detection of the particular detected detectable object;

(n) periodically uploading to said central database trip starting and/or ending locations where detected detectable objects were detected, together with the respective time of detection of detected detectable objects associated with the respective identifier to update the detected locations and respective times of detection of detected objects;

(o) periodically updating information stored in said local memories by downloading to said local memories from said central database, for a plurality of identifiers, the updated detected locations and respective times of detection of detected objects in the updated central;

(p) determining, upon the detection of a certain detectable object at a certain detection time, a fare to be charged by searching the local memory associated with the detector for a detection of said certain detectable object at a time proximate said certain detection time;

(q) following said determination of said fare to be charged, allowing passage through a fare gate coupled to said detector if sufficient available value is associated with said detected detectable object; and (r) following said determination of said fare to be charged, not allowing passage through a fare gate coupled to said detector if insufficient available value is associated with said detected detectable object, wherein the provision of detectable object identifier-associated information results in reducing the time to determine fare value sufficiency and the time to charge the fare value and reduces lines at said gates.

13. A method as in claim 1, wherein said available fare value data receiving databases may be accessed and updated over a publically accessible network.

14. A method as in claim 1, wherein said identifier is also printed on the front of the detectable object.

15. A method as in claim 1, wherein available fare value may be credited from an associated mobile money account, bank account, credit card, prepaid card or the like.

16. A method as in claim 15, wherein available fare value is automatically pulled from another account.

17. A method as in claim 1, wherein detectable objects may be used to credit cash to another account.

18. A method as in claim 1, wherein the identifier is associated to a government identification number to assist in individual location and law enforcement.

19. A method as in claim 1, further comprising:

(l) comparing, in response to the detection of said particular one of said detectable objects by one of said detectors, the available fare value, associated with the identifier associated with the detected detectable object, to a fare to be charged, and determining whether said associated available fare value is sufficient to pay said fare to be charged, wherein, in the event of determination of insufficient available fare value, a computing device located proximate the location of detection is programmed to attempt to remove funds from a mobile money account, bank account, credit card, prepaid card, fare card account or similar account in a particular order.

20. A method as in claim 1, wherein uploading and downloading is carried out over a public network.

21. A method as in claim 1, wherein said detector sends a communication to the custodian of an account associated with the identifier.

22. A method as in claim 1, wherein government subsidies are directly credited to said available fare value database and use of such subsidies is limited to transportation services.

* * * * *